US006280351B1

(12) United States Patent
Wong

(10) Patent No.: US 6,280,351 B1
(45) Date of Patent: Aug. 28, 2001

(54) STRIKING PRACTICE DEVICE

(76) Inventor: Sean Wong, 100 Havelock Gate, Markham, Ontario (CA), L3S 3P6

( * ) Notice: Subject to any disclaimer, the term of this patent is extended or adjusted under 35 U.S.C. 154(b) by 0 days.

(21) Appl. No.: 09/482,342

(22) Filed: Jan. 14, 2000

(51) Int. Cl.[7] ..... A63B 69/00

(52) U.S. Cl. ..... 473/422; 273/359; 273/371; 273/374; 273/386; 73/379.03; 73/379.05; 482/83; 473/441; 473/479

(58) Field of Search ..... 124/41.1; 73/379.02–379.09; 482/83, 84, 86, 900; 473/421–423, 429, 417–418, 415, 462, 479; 273/368, 403, 404, 408, 359, 367, 369–371, 374–376, 378, 390, 386, 387, 407; 177/184–187, 190, 195, 197; 89/42.01, 44.01, 44.02

(56) References Cited

U.S. PATENT DOCUMENTS

| | | | | |
|---|---|---|---|---|
| 411,424 | * | 9/1889 | Colby | 73/379.03 |
| 454,256 | * | 6/1891 | Cooper | 73/379.05 |
| 2,820,365 | * | 1/1958 | Detzel | 73/379.05 |
| 3,720,413 | * | 3/1973 | Ready | 473/191 |
| 3,933,354 | | 1/1976 | Goldfarb et al. . | |
| 4,027,875 | | 6/1977 | Hurley . | |
| 4,088,315 | | 5/1978 | Schemmel . | |
| 4,108,428 | | 8/1978 | Winterbottom . | |
| 4,199,987 | * | 4/1980 | Bauers et al. | 73/379.04 |
| 4,208,048 | | 6/1980 | Winterbottom . | |
| 4,353,545 | | 10/1982 | Anderson . | |
| 4,401,303 | | 8/1983 | Anderson et al. . | |
| 4,534,557 | | 8/1985 | Bigelow et al. . | |
| 4,564,192 | | 1/1986 | Lebowitz . | |
| 4,593,900 | * | 6/1986 | Burke | 482/83 |
| 4,818,234 | | 4/1989 | Redington et al. . | |
| 5,256,069 | * | 10/1993 | Snowden, Jr. et al. | 434/83 |
| 5,352,170 | * | 10/1994 | Condo et al. | 482/83 |
| 5,605,336 | | 2/1997 | Gaoiran et al. . | |
| 5,803,877 | * | 9/1998 | Franey | 482/83 |

* cited by examiner

*Primary Examiner*—Jeanette Chapman
*Assistant Examiner*—Mitra Aryanpour
(74) *Attorney, Agent, or Firm*—Dimock Stratton Clarizio; Mark B. Eisen

(57) ABSTRACT

A practice device comprising a plurality of striking targets arranged about a frame in an overall configuration which approximates the shape of an opponent. The targets are individually articulated to the frame, so that each individual target reacts independently in response to a strike. The targets are each in communication with a common force sensor, through a load transfer shaft movable relative to the frame and bearing on a force sensor such as a load cell, which provides feedback to the athlete regarding the force of each strike.

15 Claims, 5 Drawing Sheets

STRIKING PRACTICE DEVICE

FIELD OF INVENTION

This invention relates to practice targets. In particular, this invention relates to a striking practice device providing a plurality of striking targets and a sensor for providing an indication of the striking force imparted to an individual striking target.

BACKGROUND OF THE INVENTION

Practice devices having striking targets are used by athletes in martial arts and martial sports, to hone desirable qualities such as speed, coordination, accuracy and flexibility. For example, one popular practice device is a large punching bag known as a "heavy bag", also known as a "kicking bag" or "body bag", which typically comprises a canvas, vinyl or leather sac filled with a heavy material such as sand, water or the like. The filler imparts resilience and inertial resistance to the bag, reproducing the effect of striking a human opponent and thus allowing an athlete to practice potentially injurious techniques without actually harming an opponent. The heavy bag also provides the advantage of approximating the breadth and height of an opponent, which adds to the realism of the heavy bag as a practice device.

However, the heavy bag provides little feedback to the athlete regarding the accuracy or force of a strike. In general the degree to which the bag deflects under the force of a strike increases with the force of the strike, which provides a rough visual indication of striking power. However, the degree of deflection of the bag is also influenced by other factors such as the point of impact, a strike remote from the anchoring point deflecting the bag more than a higher strike of the same force near the anchoring point, and the angle of impact, since a glancing blow imparts less energy to the bag than a centred strike of equal force and thus deflects the bag less.

At a typical striking speed it is difficult for an athlete, particularly while concentrating on an exercise, to determine whether and to what extent the degree of deflection of the bag may have been attributable to factors other than the force of the strike. The heavy bag thus provides very poor feedback to the athlete, in a sport which relies very heavily on feedback to provide a means and motivation for improving the athlete's skills.

Practice devices are known which provide striking force feedback to an athlete. For example, U.S. Pat. No. 5,605,336 issued Feb. 25, 1997 to Gaoiran et al, which is incorporated herein by reference, provides a shock sensor affixed to a heavy bag for measuring the magnitude of a shock experienced by the bag during a strike. The shock sensor provides a quantified feedback indication to the athlete relating to the force of the strike. However, the shock detected by the sensor is affected by the vertical position at which the strike impacts the bag, and radial point of impact due to the rounded exterior of the bag, and thus still provides only a rough indication of the actual striking force.

U.S. Pat. No. 4,534,557 issued Aug. 13, 1985 to Bigelow et al, which is incorporated herein by reference, provides sensors associated with a variety of different types of striking targets, including a heavy bag and a number of smaller targets, to provide striking force feedback to the user. The smaller targets to some degree avoid the extraneous factors which influence the measured striking force, because limiting the size of the striking surface commensurately reduces the athlete's freedom to strike positions remote from the sensor. However, randomly positioned small targets do not realistically reflect the shape of an opponent's body, nor the arrangement of the sensitive areas of an opponent which martial arts and sports emphasize as striking targets for maximum efficacy.

As such, striking individually positioned small targets for practice does not improve the athlete's ability to selectively strike at susceptible target areas, as opposed to invulnerable or strike-resistant target areas of an actual opponent. The provision of multiple targets with separate sensors also renders this type of equipment complex and expensive.

SUMMARY OF THE INVENTION

The present invention overcomes these disadvantages by providing a practice device which comprises a plurality of striking targets arranged about a frame in an overall configuration which can be made to approximate the shape of an opponent. The targets are individually articulated to the frame, so that each individual target reacts independently in response to a strike. The targets are each in communication with a common force sensor, which provides feedback to the athlete regarding the power of each strike.

The invention accomplishes this by providing a load transfer shaft movable relative to the frame and bearing on a force sensor such as a load cell. The striking targets are hinged to the frame, preferably spring biased to a rest position, such that when an individual target is struck the force of the strike is transferred to the load transfer shaft. The load transfer shaft is thereby moved to alter a resting force on the load cell. The difference between the resting force and the striking force is output to an indicator, for example a visual indicator such as an LCD display, to provide striking force feedback to the athlete.

In alternate embodiments the striking targets may be removable, and replaceable with targets of different shape or resilience/hardness. The targets may be positioned as desired, for example to accommodate a particular martial art or style or to emphasize particular sensitive areas of an opponent. The force indicator may be visual or audible, and may be enabled by a threshold striking force. These and other embodiments of the invention will be apparent from the description which follows.

The present invention thus provides a practice device, comprising a frame, a load transfer shaft movable relative to the frame, a plurality of striking targets supported on the frame, each striking target being operably affixed to a load transfer arm movable relative to the frame and affixed to the load transfer shaft, and a force sensor in operative communication with the load transfer shaft, for providing an indication of striking force, wherein a striking force applied to a target is transferred through the load transfer arm and moves the load transfer shaft to alter a resting force of the load transfer shaft on the force sensor.

BRIEF DESCRIPTION OF THE DRAWINGS

In drawings which illustrate by way of example only a preferred embodiment of the invention.

DETAILED DESCRIPTION OF THE INVENTION

Figure 1:
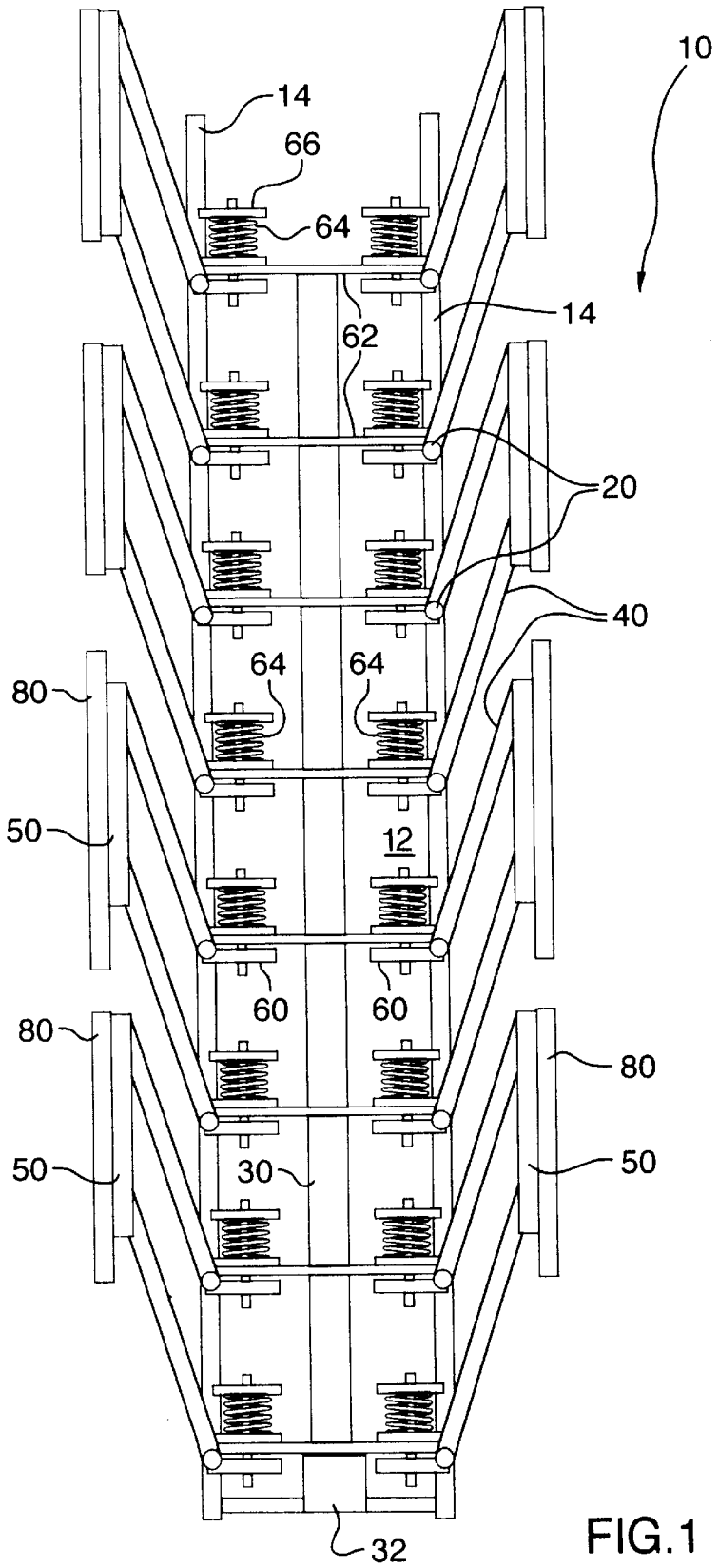
FIG. 1 is a side elevation of a practice device embodying the invention.
Figure 4:
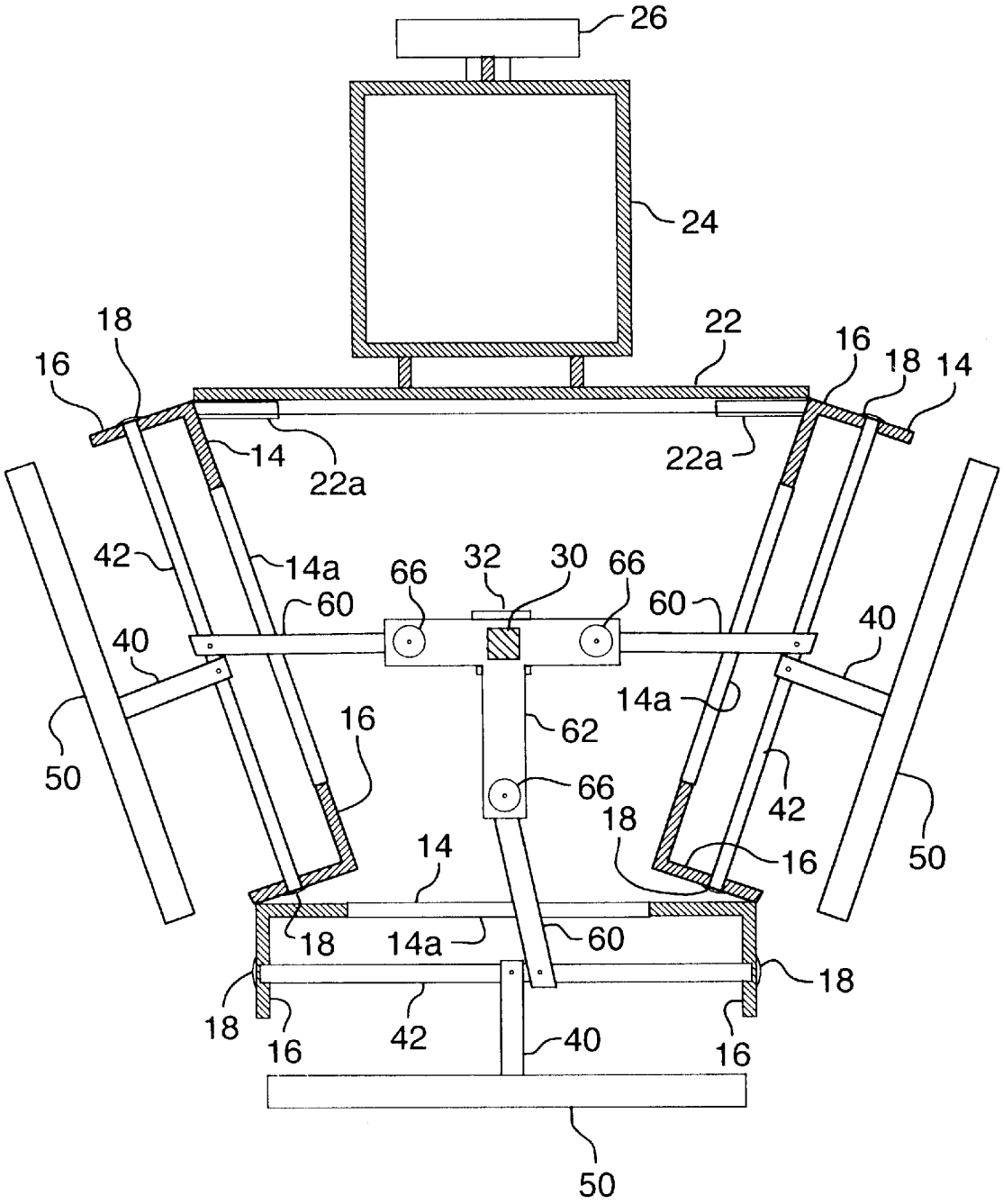
FIG. 4 is a top cross-section of the practice device of FIG. 1.

A preferred embodiment of the practice device 10 of the invention is illustrated in FIGS. 1 and 4. The device 10 comprises a frame 12, which may be free-standing or adapted to be affixed to a floor or wall, which is rigid and sufficiently strong to withstand the force of repeated strikes on the striking targets 50. The illustrated frame 12 is composed of steel and bolted, riveted, welded or otherwise suitably connected to form an integral frame structure.

The preferred embodiment of the frame 12, best illustrated in FIG. 4, comprises front and side sections 14, each channel-shaped with sides 16 for hingedly mounting sway arms 40 supporting the striking targets 50, for example on axels 42 pivotally mounted in bushings 18 for relatively free rotation. The front and side sections 14 have suitably positioned openings 14*a* through which load transfer arms 60 extend, as described below. The openings 14*a* also help to reduce the cost and weight of the device 10. Alternatively, the frame 12 may be constructed from rails, angle irons, tubes or any other suitably strong structural members, and the number of sides provided by the frame is determined by the desired number and positions of striking targets 50.

The illustrated embodiment is adapted to be affixed to a wall. A back section 22 is thus connected along rear edges of the side sections 14, for example by brackets 22*a,* rigidifying the frame 12. Projecting from the back section 22 is a spacer channel 24 having a back plate 26 with holes (not shown) for screws, lag bolts or other fasteners suitable for the wall surface to which it will be affixed.

Figure 2:
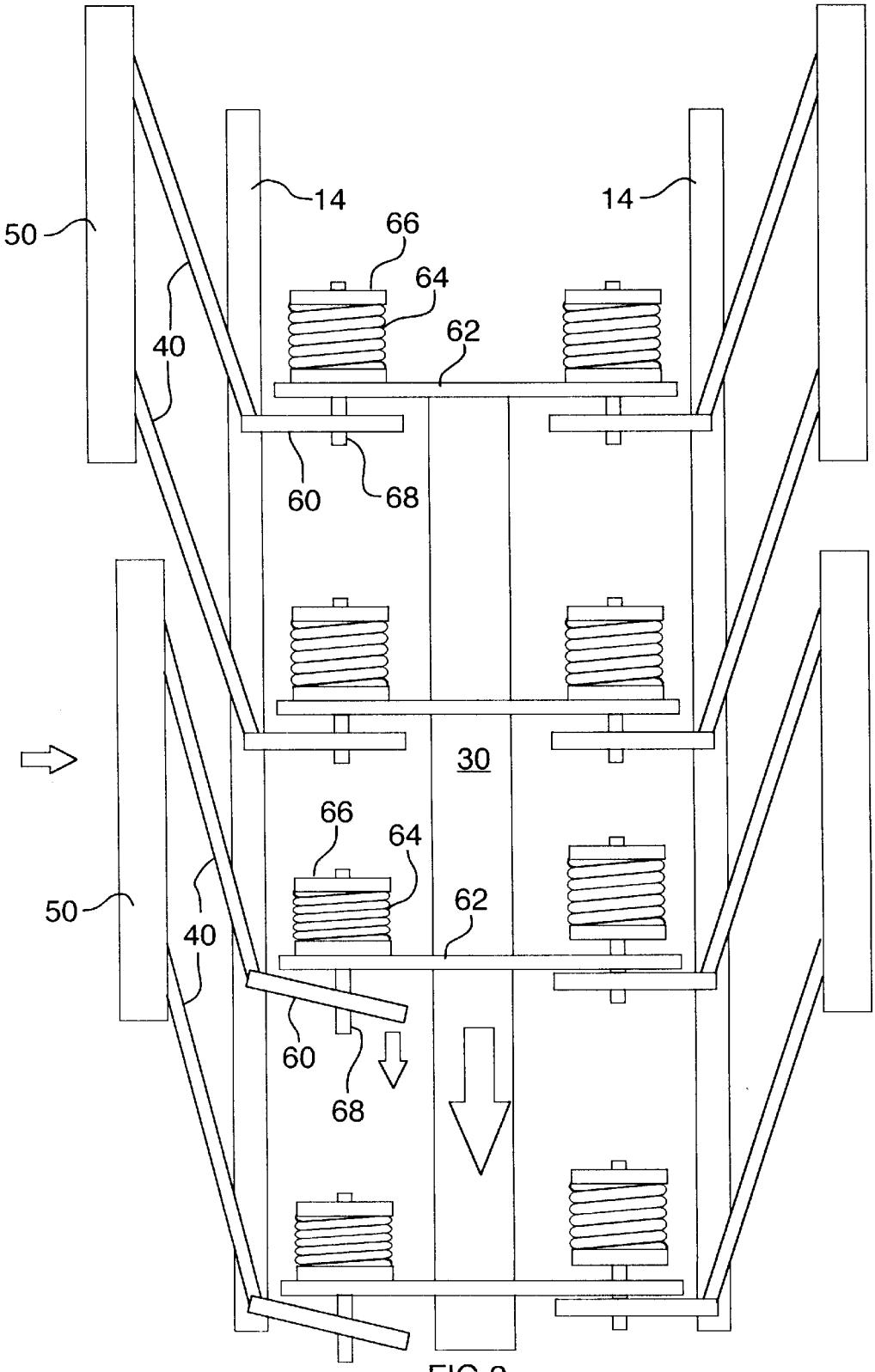
FIG. 2 is a partial elevation of the practice device of FIG. 1 showing the motion of a striking target.
Figure 3:
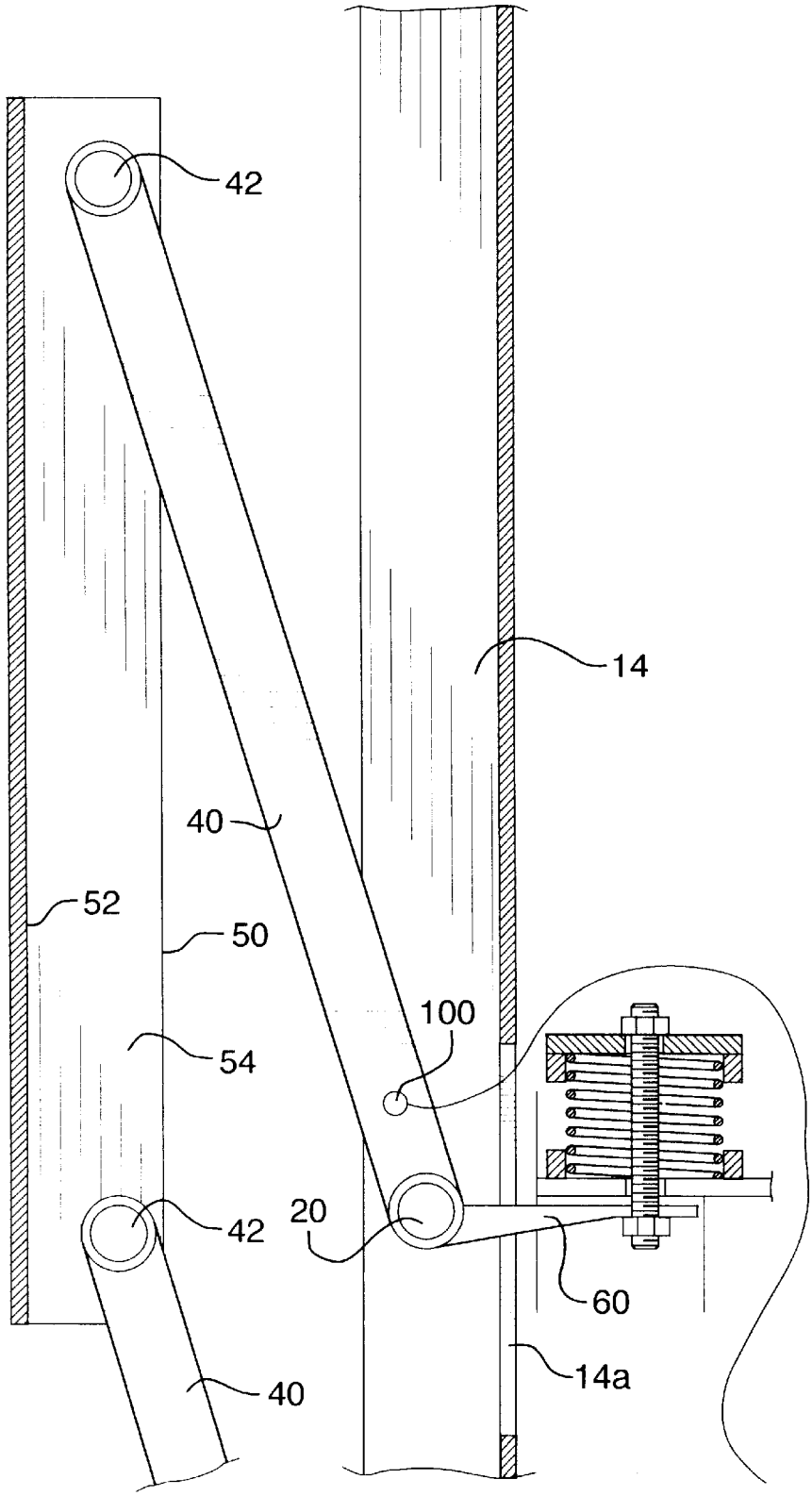
FIG. 3 is an enlarged elevation of a striking target in the practice device of FIG. 1.

A plurality of striking targets 50 are supported on the frame, each striking target 50 being mounted on preferably two sway arms 40, as shown in FIGS. 2 and 3. The sway arms 40 are preferably formed from metal, which may for example be configured as a channel or tube for strength, but may alternatively be rigid plastic, wood or any other suitably strong rigid material that will transfer the force of a strike against the striking target 50.

The striking targets 50 may comprise a mounting plate 52 to which the striking surface 80 will be mounted, integrally formed with side flanges 54. The sway arms 40 may be welded, bolted, clipped or otherwise suitably affixed to the inner face of the mounting plate 52 near both the top and bottom of the striking target 50, forming a parallelogram which maintains the mounting plate 52 generally parallel to the frame 12 at all times. The other ends of the sway arms 40 are attached to the axels 42 so as to prevent rotation therebetween, as by welding, bolts, flats or in any other suitable manner. The axels 42 are in turn pivotably affixed to the sides 16 of a front or side frame section 14. The striking targets 50 can thus pivot relative to the frame 12, and as the striking target 50 pivots the axel 42 to which it is mounted rotates in the bearings 18.

A load transfer arm 60, also preferably formed from a metal channel or tube, is similarly affixed to each axel 42 so as to prevent rotation therebetween, as by welding, bolts or in any other suitable manner. The load transfer arm 60 thus pivots with the associated sway arm 50 whenever the striking target 50 is moved by the force of a strike.

The other end of each load transfer ann 60 is operably affixed to a load transfer shaft 30 that is mounted so as to be movable relative to the frame 12, preferably disposed generally centrally within the frame 12 as shown in FIG. 4. The load transfer shaft 30 may be composed of wood, metal or any other suitably rigid material, and in the preferred embodiment rests on a force sensor 32, for example a load sensor cell, which is mounted to the frame in a stationary position. The force sensor 32 may be any commercially available load cell connected to associated detector/indicator circuitry, for example load cells manufactured by Entran Devices Inc. or Omegadyne, Inc., or may be a torque sensor, pressure sensor or the like suitably coupled to the load transfer shaft 30.

A plurality of shoulder plates 62 are axially fixed to the load transfer shaft 30, one at each position corresponding to the horizontal levels of the load transfer arms 60. In the embodiment shown, with striking targets 50 along both sides and the front of the device 10, the shoulder plates are "T"-shaped so as to provide an end corresponding to the load transfer arm 60 from each striking target 50. The shoulder plates 62 may be provided with any other configuration suitable for accommodating the positions of the striking targets 50.

Each load transfer arm 60 is affixed to one end of the corresponding shoulder plate 62, preferably through a shock absorber such as compression spring 64 retained between the shoulder plate 62 and a cap 66. The load transfer arm 60 is affixed to the end of a shaft 68 secured to the cap 66 and slidably extending through the spring 64 and the shoulder plate 62. Thus, when the load transfer arm 60 is drawn away from the shoulder plate 62 the spring 64 is compressed as the cap 66 is drawn toward the shoulder plate 62.

The load transfer arm 60 is thereby retained in a generally horizontal orientation by the shaft 68, which in a rest position holds the inner end of the load transfer arm 60 beneath the shoulder plate 62. The load transfer arm 60 is preferably spaced from the shoulder plate 62, thus allowing the shoulder plate 62 to move under the force of a strike hitting any striking target 50 without encountering resistance from other striking targets 50 in the rest position, as can be seen in FIG. 2. The load transfer arm 60 in turn retains the sway arm 40 in an oblique orientation as shown, preferably at a sharply acute angle relative to the frame 12 so that the path of travel of the striking target 50 is largely radial (horizontal) relative to the frame 12.

With this arrangement, in the rest position the plurality of striking targets 50 can be retained in substantially vertically aligned relation by the load transfer shaft 30 resting on the load cell 32. If desired, the striking targets 50 may be retained in staggered rest positions, by making suitable adjustments to the angles of the sway arms 40 for different striking targets 50.

It will be appreciated that in a basic embodiment, for each striking target 50 only a single load transfer arm 60 is required. In the preferred embodiment load transfer arms 60 are provided for both the upper and lower sway arms 40 along one side of the striking target 50. If desired, all four sway arms 40 may be provided with load transfer arms 60, however this would be unnecessary in most cases.

The striking surface 80, the rigidity of which may be selected according to the requirements of the user, may be formed integrally with the mounting plate 52 of the striking target 50. However, in a preferred embodiment a striking surface 80 is provided as a separate attachment and removably mounted to each striking target 50. This allows the user to select a striking surface 80 having suitable resilience (cushioning) for the type of practice desired. For example, a barehanded striker may desire more cushioning than a boxer wearing cushioning gloves. This also allows different sizes of striking surfaces 80 to be mounted to the striking targets in any desired arrangement, as shown in FIG. 1, to more closely approximate the sizes of targets on an actual opponent, and facilitates cleaning of the striking surfaces 80. (The striking surfaces 80, shown in FIG. 1, have been omitted from FIGS. 2 to 5 for purposes of illustration.)

In operation, when the striking targets 50 are in the rest position the load transfer arms 60 are also in a rest position beneath the shoulder plates 62. The weight of the load transfer shaft rests on the load cell 32. The load cell indicator circuitry (not shown) is calibrated to zero with the weight of the load transfer shaft 30 at rest. As a striking surface 80 is struck, the striking target 50 on which the striking surface 80 is mounted is pushed toward the frame 12, as shown by the arrow at the bottom left in FIG. 2. The arcuate motion of the striking target 50 pivots the sway arms 40, and thus the load transfer arms 60 associated with the moving target 50. The inner ends of the load transfer arms 60 draw the shafts 68 downwardly, forcing the caps 66 and thus the associated shoulder plates 62 downwardly. The load transfer shaft 30 moves with the shoulder plates 62, and the force of the load transfer shaft 30 against the detector component of the load cell 32 increases. This increase in force is indicated by the load cell indicator circuitry (not shown), which provides a visual or audible indication of force to the user.

Thus, irrespective of which striking target 50 is struck, the force of the strike is imparted to the load transfer shaft 30 and the force of the load transfer shaft 30 on the load cell 32 increases. The space between the shoulder plates 62 and the load transfer arms 60 of all resting striking targets 50 allows the shoulder plates 62 to move with the load transfer shaft 30 without resistance. When the force of the strike is removed, the load cell 32 forces the load transfer shaft 30 to the rest position.

It will be noted that for most conventional load cells 32, only a slight movement of the load transfer shaft 30 is required to obtain the desired force indication. The extent of movement of the load transfer shaft 30, load transfer arms 60 and springs 64 has been exaggerated in FIG. 2 for purposes of illustration.

It will be appreciated that any number of striking targets 50 may be mounted to the frame 12, and the orientations of the striking targets 50 may be selected by selecting the angles between frame sections 14 for any particular application.

Figure 5:
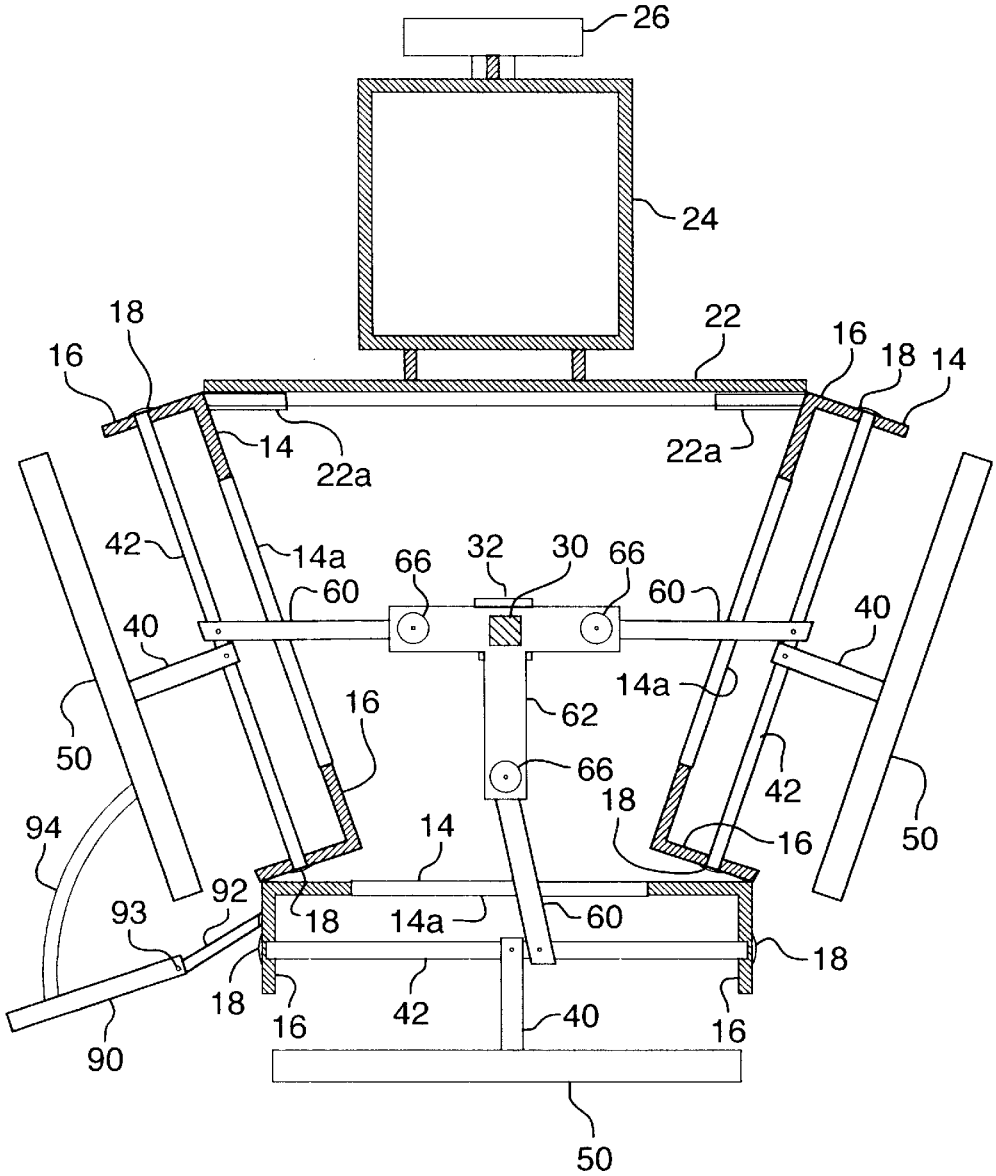
FIG. 5 is a plan view of the practice device of FIG. 1 showing a striking target extension for reorienting the striking surface.

In another preferred embodiment a striking extension plate 90 is provided, as shown in FIG. 5, which alters the angle of a striking target 50. The extension plate 90 is hingedly mounted to the frame 12 along one side of the extension plate 90, as by hinge 93 on brace 92 shown in FIG. 5, so that the extension plate 90 can pivot in a horizontal plane. An extension bar 94 projects from the rear face of the extension plate 90 and contacts the striking target 50. The striking surface 80 (not shown) can then be mounted to the extension plate 90 in any suitable fashion.

The extension plate 90 effectively changes the angle of the striking target 50 by transferring the force of a strike through the extension bar 94 to a striking target 50. The operation of the practice device is otherwise as described above. This allows for a versatile rearrangement of the orientations of the striking surfaces 80, merely by selecting the position of the brace 92 and the length of the extension bar 94, without requiring any realignment of the frame sections 14.

It will be appreciated that the indication of striking force is provided by the difference between the force of the load transfer shaft 30 against the load cell 32 at rest and the force of the load transfer shaft 30 against the load cell 32 during a strike. In the preferred embodiment the load cell 32 is positioned beneath the load transfer shaft 30, and the striking force increases the force against the load cell 32. The force sensor 32 could be positioned elsewhere, for example above the load transfer shaft 30, such that the striking force decreases the force of the load transfer shaft 30 against the force sensor 32, and the effect would be the same so long as the force sensor indicator circuitry is calibrated accordingly. The particular position of the load cell 32 in the embodiment shown is merely one preferred example.

In a further preferred embodiment of the invention a sensor 100 is affixed to a part of the strike load transfer assembly (i.e. the striking target 50, sway arms 40, axels 42 or load transfer arms 60) of each target to indicate which target has been struck. The sensor 100, shown in FIG. 3, may for example be a vibration detector, or any other sensor adapted to detect movement of the strike load transfer assembly. The sensors 100 are individually wired to a controller, for example a microprocessor, which is thus capable of discriminating between the various striking targets 50 to provide an indication to the user as to which striking target 50 has been struck. This information can be conveyed to the user by a numerical or other symbolic indication generated on a display, or by an indicator, for example a light (not shown), physically associated with the striking targets 50.

In this embodiment, as each striking target 50 is struck the sensor 100 associated with that striking target 50 sends a signal to (or closes a circuit within) the controller (not shown) in conventional fashion, and the controller in turn displays a symbol associated with the striking target 50 or activates an indicator associated with the striking target 50 to convey this information to the user.

A preferred embodiment of the invention having been thus described by way of example only, it will be apparent to those skilled in the art that certain modifications and adaptations may be made without departing from the scope of the invention. The invention includes all such modifications and adaptations as fall within the scope of the appended claims.

I claim:

1. A practice device, comprising a frame, a load transfer shaft movable relative to the frame, a plurality of striking targets supported on the frame, each striking target being operably affixed to a load transfer arm movable relative to the frame and affixed to the load transfer shaft, and a force sensor in operative communication with the load transfer shaft, for providing an indication of a striking force, wherein the striking force applied to a target is transferred through the load transfer arm and moves the load transfer shaft to alter a resting force of the load transfer shaft on the force sensor.

2. The practice device of claim 1 in which a plurality of striking targets are pivotably mounted to the frame by at least one sway arm hinged to a striking target near one end of the sway arm and hinged to the frame near an opposite end of the sway arm.

3. The practice device of claim 2 in which each striking target is provided with a pair of sway arms on each side of the striking target.

4. The practice device of claim 1 in which the load transfer arm is affixed to the opposite end of the sway arm.

5. The practice device of claim 1 in which the load transfer arm is affixed to a shoulder plate axially fixed to the load transfer shaft.

6. The practice device of claim 5 in which the load transfer arm is affixed to the shoulder plate by a resilient member.

7. The practice device of claim 1 in which the frame is provided with at least two sides.

8. The practice device of claim 7 in which the frame comprises a plurality of channel-shaped sections.

9. The practice device of claim 8 in which the frame comprises a front section and opposing side sections.

10. The practice device of claim 3 in which the striking target comprises a mounting plate having side flanges, and the sway arms are affixed to the side flanges.

11. The practice device of claim 1 comprising a striking surface adapted to be mounted on the striking target.

12. The practice device of claim 1 comprising an extension plate adapted to be hingedly mounted to the frame and to transfer a striking force against the extension plate to a striking target.

13. The practice device of claim 12 in which an extension bar affixed to the extension plate bears against the striking target.

14. The practice device of claim 1 in which a sensor for sensing a motion of the striking target is associated with the striking target, to provide an indication of a striking target that has been struck.

15. The practice device of claim 1 comprising a striking surface adapted to be mounted on the striking target.

* * * * *